US005657988A

United States Patent [19]

Kavounas

[11] Patent Number: 5,657,988

[45] Date of Patent: Aug. 19, 1997

[54] GAME EQUIPMENT AND METHOD FOR PLAYING BOARD GAMES OF ESTABLISHING AND/OR ACQUIRING CONTROL OF PASSAGE ROUTES

[76] Inventor: Gregory T. Kavounas, 9920 SW. Conestoga Dr., #199, Beaverton, Oreg. 97008

[21] Appl. No.: 588,222

[22] Filed: Jan. 18, 1996

[51] Int. Cl.[6] ..... A63F 3/00

[52] U.S. Cl. ..... 273/242; 273/254

[58] Field of Search ..... 273/236, 242, 273/243, 240, 251, 252, 254

[56] References Cited

U.S. PATENT DOCUMENTS

| | | | |
|---|---|---|---|
| 796,774 | 8/1905 | Thompson . | |
| 1,631,505 | 6/1927 | Samis . | |
| 2,026,082 | 12/1935 | Darrow . | |
| 2,239,779 | 4/1941 | Clark et al. | 273/254 |
| 2,976,044 | 3/1961 | Corpening . | |
| 3,163,423 | 12/1964 | Jackson . | |
| 3,198,521 | 8/1965 | Kramer et al. . | |
| 3,367,662 | 2/1968 | Charles et al. . | |
| 3,565,437 | 2/1971 | Mitchell . | |
| 3,759,521 | 9/1973 | Breslow et al. . | |
| 3,807,739 | 4/1974 | Henley et al. . | |
| 3,858,885 | 1/1975 | Adcock | 273/243 |
| 3,961,795 | 6/1976 | Anspach . | |
| 4,045,031 | 8/1977 | Arnold . | |
| 4,052,072 | 10/1977 | Beal | 273/254 |
| 4,136,881 | 1/1979 | Anspach . | |
| 4,216,971 | 8/1980 | Lyke | 273/243 |
| 4,225,138 | 9/1980 | Wolf | 273/243 |
| 4,368,889 | 1/1983 | Reker, Jr. | 273/243 |
| 4,809,987 | 3/1989 | Dvorak et al. | 273/254 |
| 4,907,808 | 3/1990 | Turner et al. | 273/240 |
| 5,094,460 | 3/1992 | Morse et al. | 273/254 |
| 5,129,649 | 7/1992 | Scholz . | |

FOREIGN PATENT DOCUMENTS

| | | | |
|---|---|---|---|
| 2227420 | 8/1990 | United Kingdom | 273/254 |
| 2238254 | 5/1991 | United Kingdom | 273/254 |

*Primary Examiner*—William E. Stoll
*Attorney, Agent, or Firm*—Gregory T. Kavounas

[57] ABSTRACT

Game equipment and a method for playing a new class of board games are provided. Board games of this class are played on a specially designed game board featuring a closed loop track, that is subdivided in token spaces. Track movement of the players' tokens depends on chance. Some groupings of token spaces form stations along the track. There are also passage routes that connect one station to another. The passage routes are provided for a passage route movement of the tokens that is preferably advantageous over and an optional alternative to track movement. A player may establish and/or acquire control of these passage routes to the exclusion of the other players. The game ends when there are no passage routes left. The preferred embodiment is an airline game of purchasing air routes. Each player is assumed to be operating an airline, and the board presents a map. The track is a roadway that is subdivided in token spaces, some groupings of which are stations shown as cities. Each city has an airport. The passage routes are air routes that connect the airports of the various cities. The preferred track movement is by rolling a die, and passage route movement is optional, and performed by a single jump. Establishing and/or acquiring control of an air route is by purchasing it. Once an air route is owned by a player, the other players must pay an air fare to use it.

16 Claims, 5 Drawing Sheets

410

TABLE OF VALUES

| CLASS OF AIR ROUTE | COST TO BUY | SALARY RAISE | AIR FARE | BONUS IF LAST | RETURN REFUND |
|---|---|---|---|---|---|
| J1 | 1,000 | 50 | 200 | 400 | 500 |
| J2 | 2,000 | 100 | 400 | 800 | 1,000 |
| J3 | 3,000 | 150 | 600 | 1,200 | 1,500 |
| J4 | 4,000 | 200 | 800 | 1,600 | 2,000 |

FIG. 4

GAME EQUIPMENT AND METHOD FOR PLAYING BOARD GAMES OF ESTABLISHING AND/OR ACQUIRING CONTROL OF PASSAGE ROUTES

BACKGROUND OF THE INVENTION

1. Field of the invention

The present invention is related to the field of board games.

2. Description of the prior art

Board games that include play-money have adopted terms related to actual wealth, such as money, salary, cash, assets, investments, etc. without the prefix "play-". In such games, the players typically pursue wealth in some manner that usually relates to investments. They start with some cash, are paid a salary, and invest money to control assets, usually by purchase and ownership. Such assets that are available for control usually have some return on investment, designed to enhance the player's wealth. In some of these board games the board presents a track subdivided in token spaces. The players move tokens around the track, usually according to the roll of the dice. In such games, a player's eligibility to purchase an asset is often determined by various factors, such as by the movement or position of tokens.

A problem in the prior art is the length of time a game might last. A game might not be socially enjoyable if it takes a very long time to end formally. One prior art solution to this problem is to limit the game time by relying on artificial external factors, such as either a maximum game time, or a fixed number of rounds of play.

Another problem in the games of the prior art is that side competitions for acquisition of specially desired assets can be passive, because of the lack of control of where a player's token will go. The lack of control results from rules of movement of the token that depend exclusively on chance. For example, in the game of MONOPOLY (U.S. Pat. No. 2,026,082), the BOARDWALK property is, at least theoretically, the most desirable property (asset) to purchase, as it has the highest percent return on investment, and additionally there is a Chance card that will send tokens directly to the property during the game. The rules of acquisition of the game dictate that whoever lands on a property first has a first option to buy it. As a result, there is always a side competition between players to get to the BOARDWALK space first during the game. However, this side competition is passive, in that its winner is determined by chance.

SUMMARY OF THE INVENTION

It is an object of the present invention to provide game equipment and a method for playing a new class of board games that do not have any of the above mentioned disadvantages of the prior art.

It is another object of the present invention to provide game equipment and a method for playing a class of board games that present to players assets available for control, and allow a mobility to the players' tokens that is not determined exclusively by chance.

It is yet another object of the present invention to provide a game equipment and a method for playing a class of board games that have an ending that is determined inherently by the play of the game, and not by artificial external factors.

According to the present invention, game equipment and a method for playing a new class of board games are provided. Board games of this class are called games of establishing and/or acquiring control of passage routes, and are played on a specially designed game board called an amphidrome board. An amphidrome board features a track configured as a closed (non-terminating) loop, that is subdivided in token spaces. The track is provided for a track movement of the players' tokens that depends preferably on chance. Some groupings of token spaces form stations along the track. There are also passage routes that connect token spaces of one station to token spaces of another station. The passage routes are provided for a passage route movement of the tokens that is preferably advantageous over and an optional alternative to track movement.

The board games of this new class of games revolve around the principle that a player may establish and/or acquire control of these passage routes to the exclusion of the other players, according to specific rules. A game designer can design a game belonging in this new class by choosing a specific design of an amphidrome board, along with specific rules, and also by solving general pricing problems and setting values accordingly. Victory can be determined by a point system devised to reward a player for establishing and/or controlling different passage routes. Alternately, play money can be used in the game, in which case a more detailed valuation system will have to be developed. In that case, the winner can be the player with the highest Net Worth, a preselected wealth statistic. The game preferably ends when all available passage routes have been either established and/or been acquired control of by the players.

A game belonging to the new class of games is preferably an airline game of purchasing air routes. Each player can be assumed to be operating an airline, and the amphidrome board can present a map. The track of the amphidrome board can be a roadway that is subdivided in token spaces, some groupings of which can be stations shown as cities. Each city can have an airport. The passage routes can be air routes, that connect the airports of the various cities. In such an airline game, track movement on the roadway can be by rolling a die, and passage route movement through an air route can be optional, and be performed by a single jump. Establishing and/or acquiring control of an air route can be by purchasing it. Once an air route is owned by a player, the other players must pay an air fare to use it.

A method for playing a game belonging to the new class of games includes the steps of each player playing in turn, until a predefined ending condition is met. During her turn, a player establishes and/or acquires control of passage route according to the relevant rules of the game. The player also moves a token either on the track according to a predefined set of track movement rules, or through a preestablished passage route according to a predefined set of passage route movement rules, or both, depending on the rules of the specific game. The passage route movement rules are different from the track movement rules.

Play of a game belonging to the new class of games becomes a race among players to establish and/or acquire control of as many passage routes as possible. As fewer passage routes remain available, some of them will become more specially desirable properties than others, at least until they become controlled. By controlling and/or using one or more passage routes judiciously, the players can compete for an advantageous position, from which to establish and/or acquire control of a specially desirable property. A resulting advantage is that, since mobility is not only a matter of chance, competition among players for an acquisition of specially desired properties is not passive but active. Another advantage is that, since expenses are made optional, no player is ever forced out of the game for being unable to meet them. These and other objects and advantages of the present invention will be more appreciated and understood after a consideration of the following drawings and the detailed description of the invention.

BRIEF DESCRIPTION OF THE DRAWINGS

FIG. 4 illustrates a card showing a Table of Values for use with the preferred embodiment of the present invention.

DETAILED DESCRIPTION OF THE INVENTION

Figure 1:
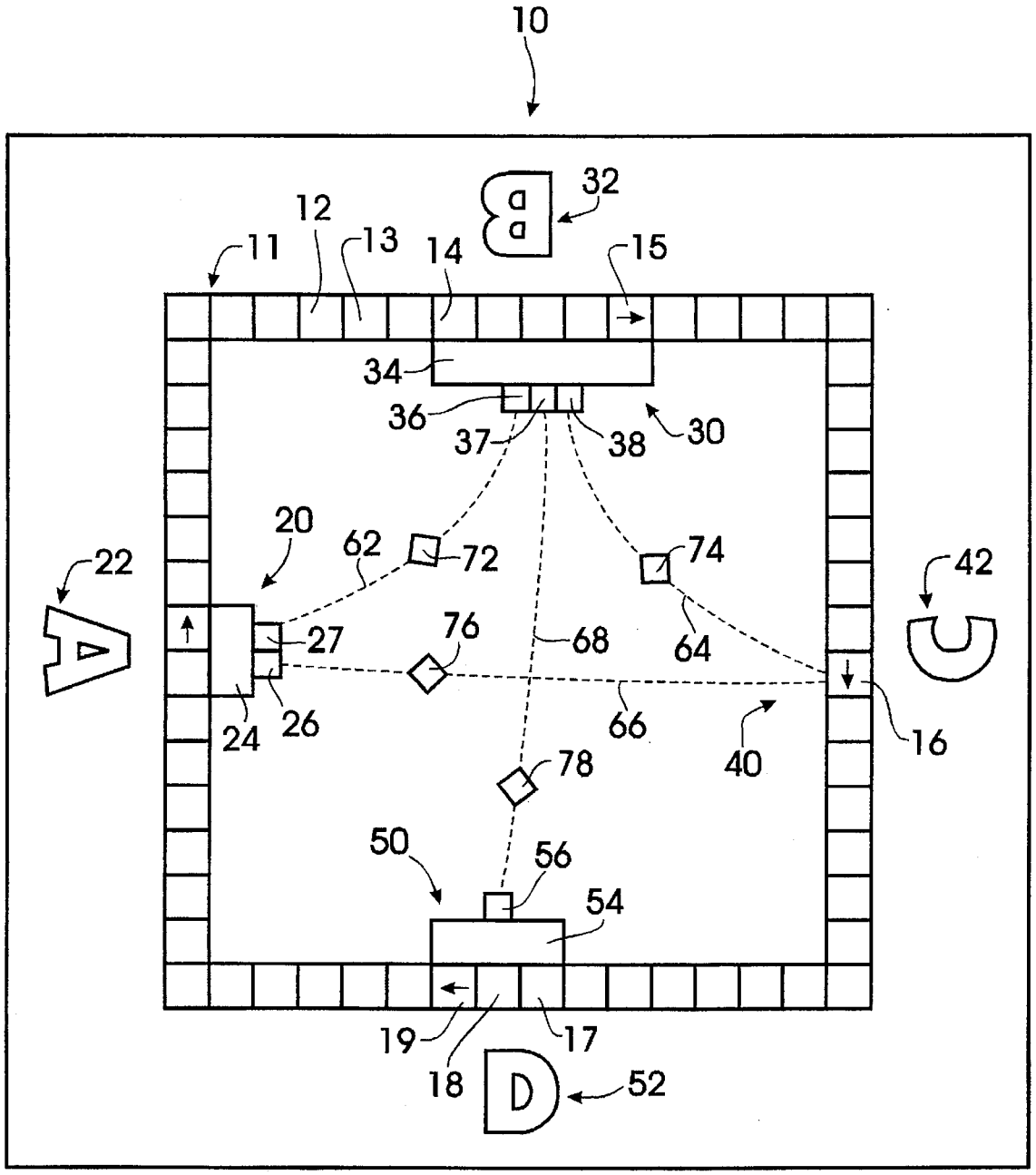
FIG. 1 illustrates an amphidrome board according to the present invention, with a generalized interrelated design of its salient features.

A new class of board games (or just "games") is described in this document, that are called games of establishing and/or acquiring control of passage routes. These games are to be played using a specially designed game board called an amphidrome board and other game equipment. In these games the players can establish and/or acquire control (to the exclusion of other players) of passage routes presented on the amphidrome board.

Game equipment

These games are provided with game equipment comprising at least player tokens, an amphidrome board, and markers. The player tokens (or just "tokens") are used to represent players on the amphidrome board, and are differentiated, preferably by color. Differentiated means differentiated from each other.

The amphidrome board can be made of cardboard or plastic or equivalent material, as is well known for boards of games in the art. The features that distinguish an amphidrome board from boards of games in the prior art will be described in the next section. It is preferred for simplicity that the features that the amphidrome board presents are simply drawn on a flat surface of it. However, the presented features may be embodied otherwise, such as by being raised, etc.

The markers of each player are suitable for, and are used on the amphidrome board to denote relationships of the players with respect to the passage routes, e.g. establishment, acquisition of control of, reservations, etc. The markers of each player are differentiated from those of any other player, preferably by color. Additionally, the markers of each player are preferably colored similarly to the color of her token. The markers can be color differentiated writing implements such as grease markers. Using them would be by drawing on the amphidrome board to denote a relationship. It is preferred that the writing implements can write on the flat surface of the amphidrome board erasably.

Alternately, the markers can be stand alone pieces, that can be placed on the amphidrome board to denote a relationship. The stand alone markers are preferably flat, and have an outline shape that matches exactly the outline of the board spaces they are intended for. Such has been found to convey better the impression of control of the space. Further, the markers are preferably transparent and not opaque. The color of a transparent marker is that color that the marker appears to have, when placed against a white background. Thus the reservation areas, individual passage route terminal spaces, and passage route indicator spaces (that will be explained below) of an amphidrome board are of preferably white color, with any designations printed therein being of preferably black color.

Preferably the game equipment of the present invention further comprises play-money (or just "money"), one or more dice, Passage Route Certificates, a Table of Values, printed game rules, and a Table of passage routes. Dice are used to provide a randomness in the track movement of tokens, and can be replaced by any equivalent mechanism such as a spinnable wheel bearing numerical indications. Inclusion or not of dice depends on the chosen rules of the game. Passage Route Certificates are awarded to a player to certify her having established and/or having acquired control of a passage route. Of course, placing differentiated markers in appropriate places of the amphidrome board can accomplish the same goal, and thus obviate the need for Passage Route Certificates. The Table of Values shows various values associated with the passage routes. Alternately, some or all of the information of the Tables could be presented instead in the Passage Route Certificates, thus obviating the need for separately provided Tables. The Table of passage routes shows which pairings of stations are eligible to be connected by passage routes, and is obviated if the passage routes are predrawn on the board.

Features of an amphidrome board

A board for this new class of games is characterized as amphidrome. The word "amphidrome" derives from a combination of the Greek words "amphi" (meaning two, both or either) and "dromos" (meaning road, way, course, or avenue). "Dromos" is not to be confused with the suffix "dromio", which denotes a specialty course, e.g. a course for horses. Both "dromos" and "dromio" have been borrowed by English (e.g. "palindrome" and "hippodrome"), but confusingly in the same form, namely "drome". The name is chosen because an amphidrome board generally presents two alternative avenues for token movement, namely a track movement and a passage route movement.

Amphidrome boards present salient features and contextual features. The salient features of an amphidrome board are:

a) a track subdivided in token spaces;

b) stations formed by specific groupings of (one or more) token spaces; and c) passage routes that are available for establishing and/or controlling by players.

All other features of an amphidrome board are optional and thus contextual. FIG. 1 of this description shows an amphidrome board 10 according to the present invention. The salient features are hereby described in detail:

Track

The amphidrome board 10 features a track 11 that is provided for track movements of the tokens. The track 11 is continuous and in a single loop, as is preferred for amphidrome boards. The track 11 is subdivided in token spaces along its length, some of which are token spaces 12, 13, 14, 15, 16, 17, 18, 19, etc.

The track movement of the tokens along the token spaces of the track is intended to be controlled by a predefined set of track movement rules of the game. In a game where track movement is allowed in only one direction, arrows such as those in spaces 15, 16, and 19 can point to the allowed direction as a reminder to the players. Alternately, a track can be subdivided in two lanes, one for clockwise and one for counterclockwise track movement.

Stations

Some of the token spaces of the track 11 are grouped in predetermined stations 20, 30, 40, and 50, for the purposes of being connected to at least one passage route, as will be explained below. The stations 20, 30, 40, 50 are given identification names by indicia 22, 32, 42, 52, such as the legends "A", "B", "C", "D". Each station is formed by one, or the grouping of more than one token spaces. The grouping of spaces is preferably indicated by proper design around the associated token spaces. The grouping of spaces should be such that there are at least two distinct stations presented on the track. It is also possible (but not preferred) that a single token space can belong in more than one stations. It is not necessary that a station be formed by more than one token space. For example, station 40 comprises a single token space 16. Even without its optional identification name, token space 16 would be a station because at least one predetermined passage route terminates at it, as will be explained below.

An optional feature of a station is a reservation area. Each station 20, 30, 50 features a reservation area 24, 34, 54 respectively. Station 40 does not feature a reservation area. A proper design of the reservation area of a station can further indicate which grouping of the token spaces formed it. According to such a design, each of the reservation areas 24, 34, 54 is shown as sharing a common side with its associated token spaces. Another optional feature of each station 20, 30, 50 is individual passage route terminal spaces 26, 27, 36, 37, 38, 56, which are provided because they work well with the preferred rules of the game. The reservation areas 24, 34, 54 and the individual passage route terminal spaces 26, 27, 36, 37, 38, 56 are shown as blank. They could, however, bear designations relating to their function.

Passage Routes

The amphidrome board 10 of the present invention also features passage routes 62, 64, 66, 68, shown as dashed lines to denote connections between stations. The passage routes are intended to connect a first station to a second station, that is distinct from the first station. The passage routes are provided and intended for passage route movements of the tokens, according to a predefined set of passage route movement rules of the game. A feature of games belonging in the new class of games is that a player can establish and/or acquire control of a passage route to the exclusion of other players, according to establishment and/or acquisition of control rules of the game set by the game designer.

According to the embodiment of FIG. 1, the passage routes 62, 64, 66, 68 are predrawn on the amphidrome board, as is preferred. Such is not necessary, as long as rules define predetermined pairings of stations that may be connected by a passage route during the game. If the relative valuation of all possible passage routes has been performed in advance, then the possible passage routes are considered constructively predrawn on the amphidrome board, even if they are not actually drawn.

Further according to the embodiment of FIG. 1, each passage route actually terminates in an individual passage route terminal space of a station, instead of terminating directly in its reservation area. For example, passage route 62 terminates in individual passage route spaces 27 and 36. Such is done because it works well with the preferred rules of the game.

Additionally, each of the passage routes 62, 64, 66, 68 optionally features a blank passage route indicator space 72, 74, 76, 78, respectively, shown associated with its passage route. Each passage route indicator space 72, 74, 76, 78 may optionally have written within it designations about its associated passage route, such as which stations it connects. Additionally, each passage route indicator space 72, 74, 76, 78 is preferably of the same shape and size as the individual passage route terminal spaces 26, 27, 36, 37, 38, 56, so that a similar stand alone piece can be used as a marker for placement on each.

Interrelated design of salient features

The salient features of the amphidrome board 10 (namely track with spaces, stations, and passage routes) have a specific interrelated design. The salient features can be varied, and thus made to have a different interrelated design, to produce another amphidrome board belonging to the new class of board games of establishing and/or acquiring control of passage routes.

The total number of spaces along the track can be varied. What can also be varied is the number of spaces that comprise each station, and the relative distances between the neighboring stations. What can further be varied is the relative distribution of passage route endings to stations, i.e. how many (and which) passage routes connect a station to any other, and by how complete a network of passage routes, etc. It is generally preferred that at least two passage routes terminate in each station; such a design helps establish a more complete network of connecting passage routes. Further, nothing forbids having two or more distinct passage routes that connect the same pairing of stations.

Accordingly, the interrelated design of the salient features shown in FIG. 1 is not the only possible one. In fact, it is not the preferred one, as will be understood from game design considerations that will be optimized below. The embodiment of FIG. 1 is shown only to demonstrate the wide array of designs that are possible for an amphidrome board.

Passage route valuation considerations

General pricing is performed while designing the game, with a goal of producing a playable game. General pricing is the process of deciding what the assets should cost, and what rewards players should receive during the game. General pricing will necessarily take into account considerations arising out of a valuation of passage routes. Valuation of passage routes will be performed by the game designer to determine what it should cost to establish and/or acquire control of a each passage route, and how much benefit a player should derive from such establishment and/or acquisition of control. Valuation will reduce the cost and benefit to a common denominator, such as points accumulated or money units. At this point of the description, the interrelated design of the salient features of the amphidrome board 10 gives rise to considerations about differences in the valuation of the passage routes relative to each other.

A first step to valuation of a passage routes is arriving at a "passage route value". This passage route value can be related to the cost and difficulty of establishing and/or acquiring control of one passage route as opposed to another, and its "usefulness" after that. A passage route is more useful if it connects stations that are more remote from each other (as counted along the track 11). Additionally, usefulness is determined by how unique a passage route is, in connecting two stations, how well connected its stations are to a network of other passage routes, etc. Disparities in usefulness (and thus also in value) of passage routes arise due to asymmetries in the design of the salient features of an amphidrome board.

A prime consideration for arriving at an initial passage route value is distance covered. Counting the number of spaces along the track becomes a way of measuring relative distances. Thus, an initial passage route value could be set as proportional to the number of token spaces of the track that are being bypassed, when the passage route is being used. Accordingly, in FIG. 1 passage routes 62 and 64 offer the user a track bypass of an about equal number of token spaces, and therefore should have similar initial passage route values. Further, each of passage routes 66 and 68 offer a passage of (about) twice as many token spaces as either passage route 62 or passage route 64, and accordingly should have about doubled initial passage route values.

These initial passage route values should be modified to account for asymmetries encountered around the loop of the track. An asymmetry is where track movement is allowed only in one direction. If the allowed direction is the one shown by the arrow in space 16, then passage route 62 will be more valuable than passage route 64. Another set of asymmetries is that station 30 ("B") has more token spaces (five) and more passage routes reaching it (three) than any other station. Each of these asymmetries may add to or subtract from the initial value of each passage route that terminates in station 30, further depending on the rules of establishment and/or acquisition of control. What could additionally distort the comparative initial values of the passage routes is asymmetries in the distribution of passage routes from the point of view of the stations. For example, passage route 68 is the only passage route that connects station 50 to a possible network of other passage routes, which therefore makes passage route 68 more valuable than passage route 66.

Thus, while lacking some sort of "uniformity", the design of the salient features of the amphidrome board 10 of FIG. 1 helps bring out many of the valuation considerations in designing an amphidrome board according to the present invention.

Optimization of the interrelated design of the salient features

It is desired that the salient features have an interrelated design that simplifies the above described passage route valuation considerations. The preferred such interrelated design is for the salient features to exhibit loop symmetry, which is a specific type of uniformity for an amphidrome board in the context of the present invention. An example of an amphidrome board with features that exhibit loop symmetry is the amphidrome board 210 of FIG. 2. Loop symmetry is exhibited where:

(a) there is only one track; and (b) the track is not branching at any point; and (c) the track forms a closed loop; and (d) each station has been formed by a grouping of a similar number of token spaces as any other station; and (e) each station is an equal number of spaces away from either one of its immediately neighboring (considered along the track) stations; and (f) all possible pairings of stations are eligible to be connected or already connected with exactly one passage route.

Figure 2:
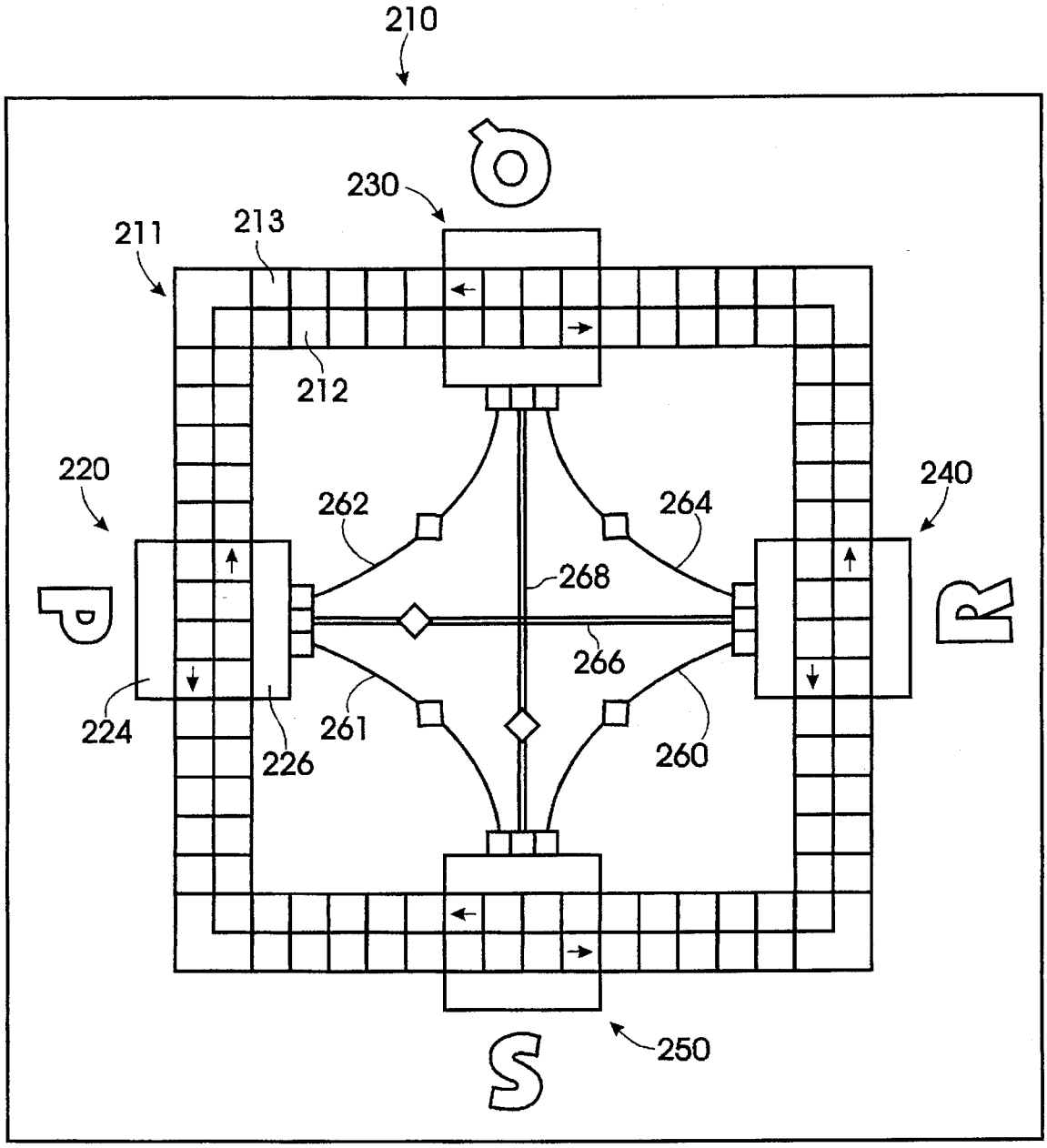
FIG. 2 illustrates an amphidrome board with a interrelated design of its salient features that exhibits loop symmetry.

In addition to the loop symmetry, the design of FIG. 2 allows for bidirectional movement by having its track 211 be subdivided in two lanes, namely 212 and 213. Further, the token spaces of each station occur successively within their grouping. In addition, the amphidrome board 210 of FIG. 2 features reservation spaces split in two portions. For example, the reservation space of station 220 ("P") is split in portion 224 and portion 226.

It has been found that loop symmetry confers great advantages in designing a game according to the present invention. The reason is that a uniform network of passage routes is presented, which does not favor any one station over another. This is true even if track movement is allowed only in one direction. Additionally, loop symmetry simplifies greatly passage route valuation, while still providing for exciting play. Loop symmetry causes the values of all passage routes to become grouped in just a few categories. Each passage route offers a passage identical in distance to every other passage route in its category. Therefore, each passage route is valued identically to all passage routes within its category. Accordingly, in arriving at an initial passage route value, the token spaces between the stations need no longer be counted (at least for a first approximation).

More specifically, where there is loop symmetry, the total number of stations N becomes a dominant statistic. In FIG. 2 there are N=4 stations, namely stations 220, 230, 240, 250. A larger such number N will simply make for a game of longer duration. Where there are N stations, there will be N/2 categories of passage routes if N even, and (N−1)/2 categories if N is an odd number. In FIG. 2, with N=4 stations there will thus be only N/2=4/2=two categories of jump routes. Additionally, where there are N stations, there will always be a total of $R=N\times(N-1)/2$ passage routes. In FIG. 2, there are $R=N\times(N-1)/2=4\times(4-1)/2=4\times3/2=12/2=6$ passage routes, namely 260, 261, 262, 264, 266, and 268.

When loop symmetry is present what matters mostly for valuing passage routes is "how many stations away" the passage route can take a player, through a passage route movement. There will be as many answers as the number of categories of passage routes (which is two for FIG. 2). Specifically, of the R passage routes, N will be connecting stations that neighbor each other along the track. As can be seen in FIG. 2, of the R=6 passage routes, there are indeed N=4 passage routes (namely passage routes 260, 261, 262, 264) that connect a station merely to its neighbor station. These four passage routes will all offer the token a bypass of an equal number of token spaces along the track. Therefore, passage routes 260, 261, 262, 264 can all be valued identically to each other. For game design purposes, they can be assumed to form one category of passage routes. A name for the category of passage routes 260, 261, 262, 264 could be J1, as they offer a "Jump of 1 station away". Passage routes of the same category can all be denoted by a similar demarcation on an amphidrome board. This demarcation is a single line on the amphidrome board 210 of FIG. 2.

In FIG. 2 there are also 2 passage routes 266, 268 of the J2 category. The category is called J2, because these passage routes offer a "Jump of 2 stations away". The demarcation for these passage routes 266 and 268 is thus a double line on the amphidrome board 210 of FIG. 2. These passage routes are also equivalent to each other, and can be valued identically to each other.

Even more so, at least to a first approximation, a passage route in the J2 category (e.g. passage route 266) offers about "double" the track bypass of a passage route in the J1 category (e.g. passage route 260). The approximate relationship remains true no matter how large the number of stations N becomes, which facilitates passage route valuation even more. Additionally, the relationship would be exact if each station were constituted by exactly one token space only. Thus, loop symmetry enables the game designer to fine tune other parameters of the game more easily.

A resulting substantial advantage offered by designs that exhibit loop symmetry is that the assets (i.e. passage routes) become distributed around the amphidrome board evenly. Indeed, stations appear at equal intervals along the track, and each station is home to a similar variety of assets as any other station. These assets range in price and difficulty to control, but the "picture" to each player is the same from any station around the amphidrome board. So, at least initially, each player has an equal opportunity to control expensive or inexpensive properties from any place on the amphidrome board.

Method of playing the games

The present invention further relates to a method for playing the games of establishing and/or acquiring control of passage routes. The method is to be used by a plurality of players who use the game equipment as described above, namely at least tokens, markers and an amphidrome board. Although different methods are described herein, they are regarded as essentially equivalent, in that the concepts "to establish" and "to acquire control of" are equivalent, as applied to passage routes in the context of these board games.

According to a first method of playing a game of establishing and/or acquiring control of passage routes, a first player uses a marker on the amphidrome board to denote establishment of a passage route connecting a first station to a second station distinct from the first station, if desired by her and permitted by establishment rules of the game. The first player also makes a token movement of a token on the amphidrome board. Then a second, and then all succeeding players in turn repeat the same steps as the first player. A round of play is thus competed when all players have had one turn. Then the players repeat and complete rounds of play until a predefined ending condition is met during a final round.

An alternate method for paying a game of the present invention is based on the amphidrome board's further presenting at least one passage route connecting two distinct stations. According to the alternate method, a first player uses a marker on the amphidrome board to denote acquisition of control of a passage route, if desired by her and permitted by acquisition of control rules of the game. The acquisition of control of a passage route by a player is to the exclusion of the other players. The first player also makes a token movement of a token on the amphidrome board. Then a second, and then all succeeding players in turn repeat the same steps as the first player. A round of play is thus competed when all players have had one turn. Then the players repeat and complete rounds of play until a predefined ending condition is met during a final round.

In both of the above described methods, the token movement is one of predefined allowable combinations of track movements on the track according to predefined track movement rules of the game and passage route movements through a passage route according to predefined passage route movement rules of the game. The passage route movement rules are different from the track movement rules. Additionally, it does not matter whether the movement step of a player comes before or after the establishing and/or acquisition of control step. That again is a choice of the general rules, left up to the game designer.

Further, in both of the above described methods, if the markers are writing implements, they are used to draw on the amphidrome board. If, as is preferred, they are stand alone pieces, they are placed on the passage route indicator spaces of the amphidrome board.

Rules

A person skilled in the art can create different games of the new class of board games by choosing specific rules from different sets of rules. The sets of rules include general rules, track movement rules, establishment and/or acquisition of control rules, passage route movement rules, money flow rules, and ending condition. The implementation of the preferred set of rules makes it so that it is preferred to use money for transactions.

General Rules

General rules speak to general matters, plus to coordination of the other sets of rules. For example, they will dictate what combinations of track movements and passage route movements are allowable per turn, if the establishment and/or acquisition of control steps are expected to happen before or after a player's token movement, whether a player receives a salary if she refuses or is not able to make a token movement during her turn, what types of agreements the players are allowed to make with each other, etc. Optionally and preferably, the general rules specify that, if the final round is not completed, the remaining players will take further turns to complete it.

Track movement rules

The chosen track movement rules govern the track movement of tokens. It is preferred that the track movement depends exclusively on chance. Dice can be used, etc. However, these rules can be deterministic, e.g. a player may only move up to three token spaces per turn. Another choice of track movement rules is on the issue of what happens when two tokens coincide on the same token space, etc. Such choices may give rise to scenaria such as where a token can not make a track movement, etc. A preferred rule is that a track movement can be stopped short within the track spaces of a station, if desired.

In the case where the track is subdivided in two lanes of opposite direction of movement, it is preferred that the track movement rules allow crossing from one lane over to the other, for increased mobility. The preferred such rule is that a token is confined to moving only in its present lane, but has choice of lanes when reentering the track from a passage route.

Establishment and/or acquisition of control rules

The establishment rules govern a player's establishment of a passage route. The term "establishment rules" is intended especially for rules in games with amphidrome boards where the passage routes are not predrawn on the board, but their valuation has been predetermined. Games where the passage routes are not predrawn will require "establishment" of passage routes, and the markers then will preferably be writing implements. The acquisition of control rules govern a player's acquisition of control of a passage route. In games where the passage routes are predrawn, one passage route indicator space is also shown associated with each passage route, and the markers are preferably stand alone pieces suitable for placing on the passage route indicator space. A game of establishing and/or acquiring control of passage routes can have either set of rules or both sets of rules. According to the preferred embodiment, the establishment rules are actually combined with the acquisition of control rules. Establishment of a passage route by a player is by purchase, which simultaneously confers on her control of the passage route to the exclusion of the other players. Accordingly, and depending on the nature of these rules, a game in this class of games can equivalently be a game of establishing passage routes, a game of acquiring control of passage routes, a game of buying passage routes, etc.

It is highly preferred that the acquisition of control rules require the tokens to travel around the track, in order for the player to be permitted to establish and/or acquire control of a passage route. Preferably the travel would be to at least one of the stations served by the passage route. The preferred rule for establishing and/or acquiring control of a passage route is that a player is permitted to do so after having "secured a reservation" at each one of the stations that the passage route connects. Securing a reservation is preferably denoted by the player placing one of her stand alone markers on the reservation area of the station.

Thus the method could further comprise the step of the first player placing a marker on the reservation area of the associated station to secure a reservation during her turn, if desired by her and permitted by the establishment and/or acquisition of control rules of the game. A preferred rule is that a player is permitted to secure a reservation if she lands on a token space associated with the station coming from the track (i.e. not via a passage route), and by an exact roll of the dice. It is preferred that securing a reservation also costs money, but that is not necessary. Further, in an amphidrome board wherein the interrelated design of the salient features exhibits loop symmetry, the cost of securing any reservation throughout the game can be initially uniform. This simplification will allow other pricing considerations to be fine tuned, as will be seen below. More rules will have to be devised as to what happens when different player's reservations compete with each other for the same passage route, etc.

At the time it is secured, a reservation is preferably specific to the station, but not necessarily specific to the passage route it is eventually intended for. A further preferred rule is that, as soon as all passage routes terminating in a station have been established and/or acquired control of, any reservations remaining in the station are automatically canceled, and their stand alone pieces are summarily returned to the players.

Additionally the step of using a marker to denote establishment (if establishing rules are being used) or acquisition of control (if acquisition of control rules are being used) would therefore further comprise the step of the player removing a marker from each of the reservation areas associated with the first station and the second station connected by the passage route, to surrender the two corresponding reservations. The player preferably denotes the acquisition of control by moving the marker from each of the reservation areas of the two stations to the individual passage route terminal spaces that correspond to the passage route. It is preferred that the eventual establishment and/or acquisition of control of a passage route costs money, but that is not necessary.

Passage route movement rules

The chosen passage route movement rules govern the passage route movements of the tokens. The passage routes are intended to provide a path of movement that is advantageous over and an optional alternative to track movement.

The passage route movement rules include eligibility and transition rules. Preferably the passage route movement is allowed in either direction of a passage route, and is not conditioned on chance. The preferred transition rule is that a passage route movement is by a single jump, from any token space of the station of origin to a specifically determinable token space of the station of destination, such as to the token space with the arrow. Other transition rules could involve the token waiting in the reservation area for a turn, etc.

Eligibility rules are rules speaking as to whether movement through a specific passage route is allowed or not, and when. For a passage route that has not been established and/or acquired control of by a player yet, the game designer must decide whether to allow such movement or not. If such movement is allowed, the next choice is whether (i) the movement is for free (i.e. passage routes are public until controlled), or (ii) the player must pay a usage fee (to the bank) for moving. The usage fee can be determined by various ways. One such way would be as a percentage of the passage route value.

For a passage route that has been established and/or acquired control of by a possessor player, the eligibility rules are preferably different. The possessor player can preferably use the passage route for free. Thus, a partial reward to a player for establishing and/or acquiring control of a passage route is enhanced mobility. For the remaining players, movement through the controlled passage route may be (a) disallowed entirely, or (b) allowed, but preferably subject to a usage fee, payable to either the bank or to the possessor player. The usage fee can be determined by various ways, for example as a percentage of the cost to establish and/or acquire control of the passage route. This usage fee can be of a different amount from the usage fee described above.

Movement through passage routes enhances the mobility and control of the players, thus making the position of their tokens not determined exclusively by chance. Indeed, while chance determines the track movement, the player has a lot more control in passage route movement. Thus, competition for the acquisition of control of desired properties (passage routes) is active (i.e. not passive) among the players, since the players have some control as to where their tokens can go.

Money flow rules

The money flow rules are derived after solving the general pricing problems of the designed game. Players can have cash, receive a salary, pay usage fees, pay for acquisitions, reservations, etc. The money flow rules govern how much money and salary players start with, when usage fees are paid, how Net Worth is computed, all coordinated with the results of solving the general pricing problems.

Players are preferably given a salary. It would not be practical to pay such salary to a player for passing a specific space in the amphidrome board, as that would make some portion of the amphidrome board more important than another portion. Accordingly, players are preferably paid a salary at the beginning of each turn. A further preferred design decision is that a player's salary is increased for establishing and/or acquiring control of a passage route. The salary increase would be somehow proportional to the value of the subject passage route, and forms a measure of return for an investment. The investment here would be the total cost of establishing and/or acquiring control of the passage route, which includes the cost of the reservations in the associated stations.

Ending condition

One preferred design choice for the board games of the present invention is that the game ends when all passage routes have been established and/or acquired control of. This design choice is preferred because it makes for a game of a substantially predictable length, and all players are given an equal and continuing opportunity to see when the end of the game is coming. If that is so, it is preferred that an additional bonus is given to the player who establishes and/or acquires control of the last passage route. That is to compensate the player for the fact that she will never collect a salary increment for having established and/or acquired control of the last passage route, as the game will end at that round of play.

Other rules

The game can be augmented with other rules and features, such as having Event Cards that offer distractors, change some rules of the game, etc. The context of the Event Cards and other features can be attuned to the chosen context of the game.

Context

In the example of FIGS. 1 and 2, amphidrome boards were presented in an abstract form, without presenting a context. That was done in order to explain the mechanics of games in the new class of games. The game concept can be applied to a variety of contexts, in order to engage the imagination of the players. A context could involve space travel. The track could indicate allowable "conventional" space travel (with each token being a space shuttle), along stations that are different neighboring planet systems. A passage route could be associated with "hyperspace" travel connecting stations. Another context could involve travel by water. The amphidrome board could present a geographic map, with a body of water such as a lake or an ocean in the middle. The track could be depicted as a road surrounding the body of water and joining stations depicted as ports of call. The passage routes could be depicted as ship routes.

Figure 3:
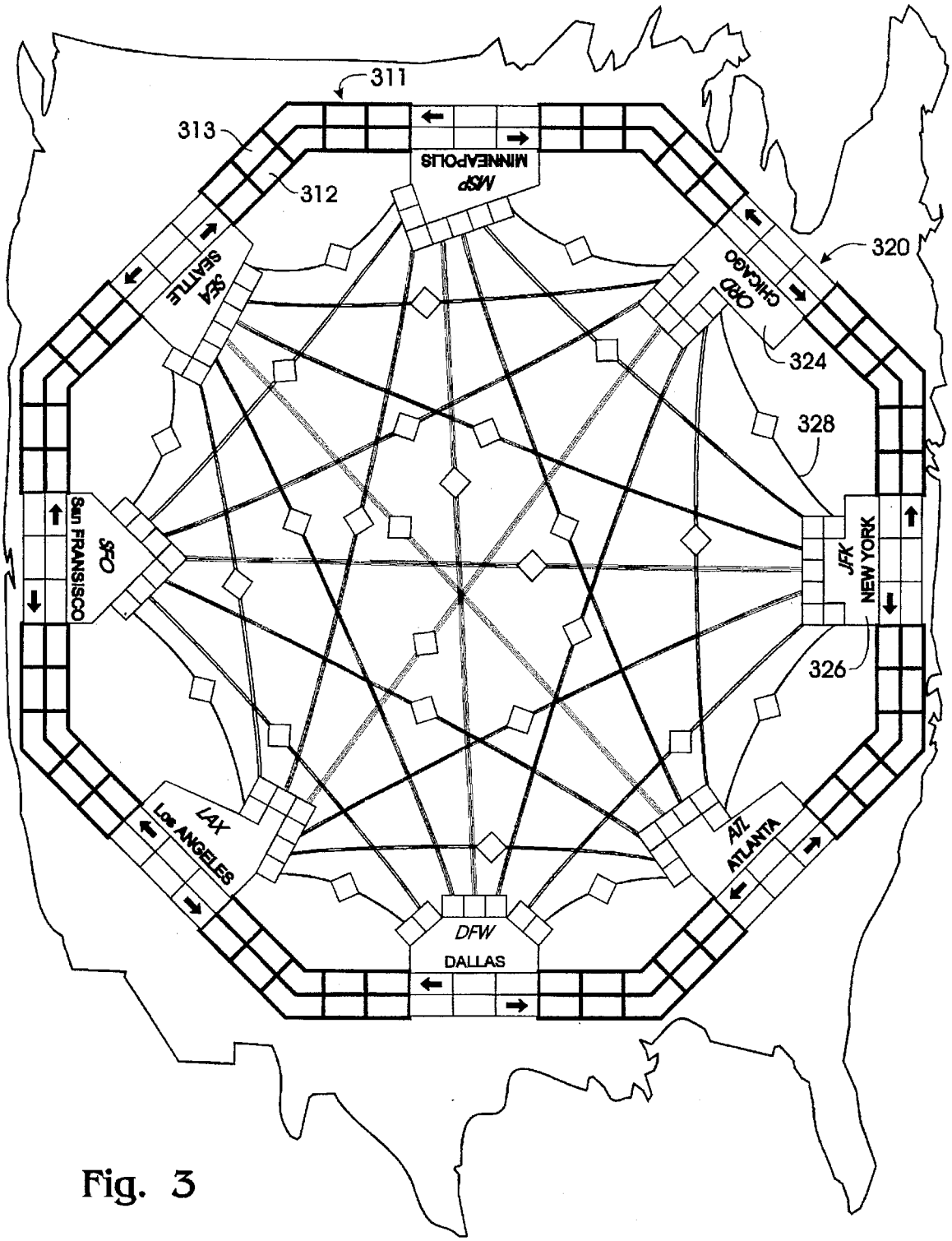
FIG. 3 illustrates a preferred design for an amphidrome board according to the present invention.

The preferred context of the game of the present invention is airline travel among cities. A design of an amphidrome board for such an embodiment is seen in FIG. 3. A track 311 is depicted as one continuous non terminating roadway, that has a lane 312 for clockwise travel and a lane 313 for counter clockwise travel. The track 311 joins N=8 stations which are depicted as major U.S. cities, e.g. "CHICAGO" 320. The reservation areas of the cities are depicted as airports, e.g. "CHICAGO"'s airport 324, and "NEW YORK"'s airport 326. The airports have different shapes for aesthetic purposes only. The passage routes are depicted as air routes, e.g. air route 328 connects "CHICAGO"'s airport 324 with "NEW YORK"'s airport 326. The salient features have an interrelated design that exhibits loop symmetry. Air route 328 connects cities that are neighboring along the track. Accordingly, it is of the J1 class and is shown by a single line. All passage routes will fall into one of the J1, J2, J3 or J4 categories. Other familiar features (passage route indicator spaces, individual passage route terminal spaces, etc.) can be discerned in FIG. 3, drawn in the same form as in FIGS. 1 and 2, but are not elaborated on for the sake of brevity. The design shown in FIG. 3 can be used in a variety of games of establishing and/or acquiring control of air routes.

Additional preferred embodiments

The preferred game is an airline game of purchasing air routes. It comprises an amphidrome board bearing the design of FIG. 3, one die, stand alone markers and play money. The rules would be the preferred rules mentioned above. Each player is assumed to operate an airline. Each airline can establish and/or acquire control of air routes by purchasing them from the Federal Aviation Administration (FAA). Once an air route is owned by a player, the other players must pay an air fare to use it. A player is eligible to purchase an air route after making a reservation in each of the airports that the air route serves. To make such reservations, a player needs to travel first to each of the corresponding cities. A player can execute such travels by "driving" on the roadway 311, or by "flying" via an already established air route. A token movement is either a single track movement or a single passage route movement. The above has been found to give about 3 hours of play.

Figure 5:
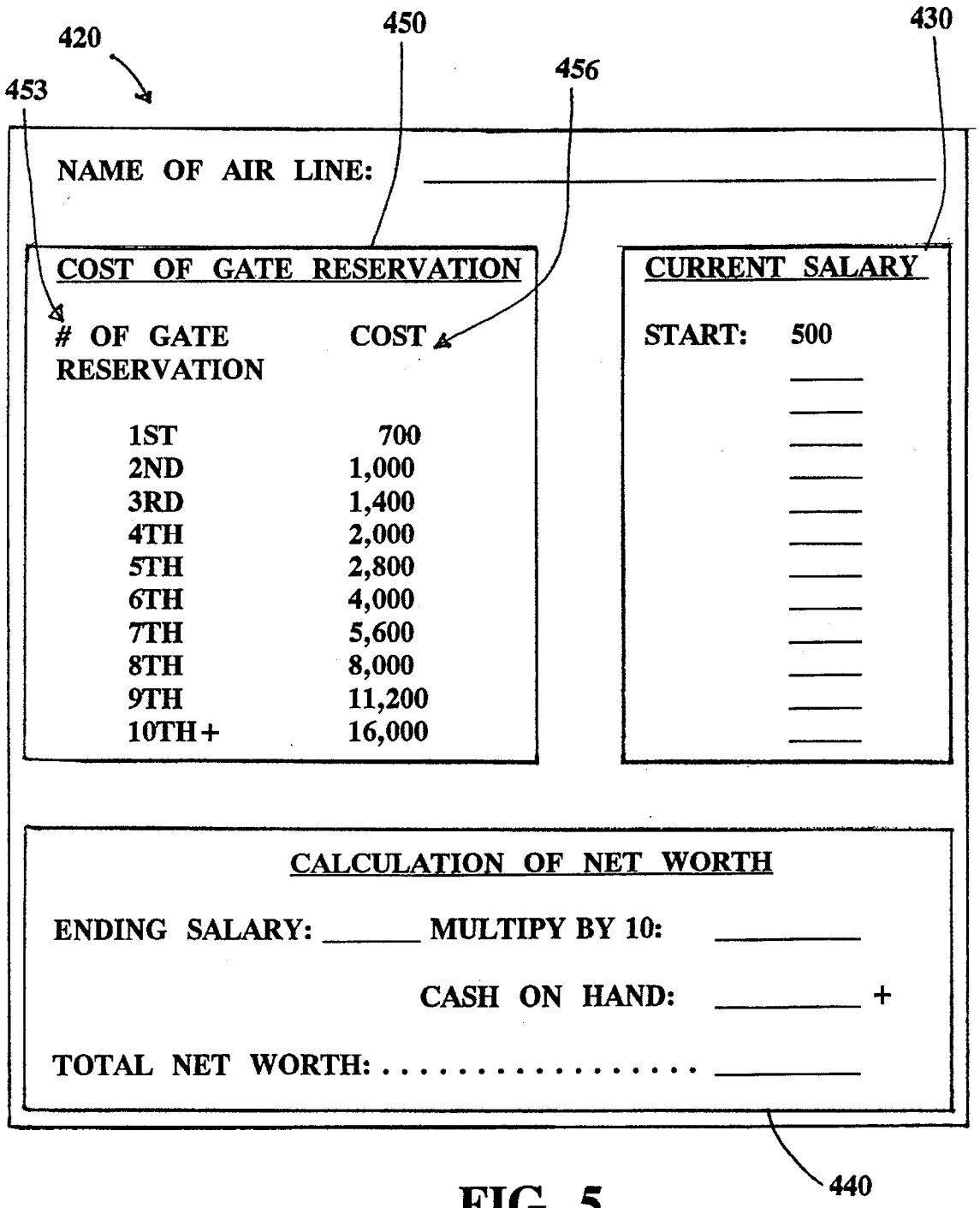
FIG. 5 illustrates a card showing a Player Note Card for use with the preferred embodiment of the present invention.

Additional preferred game equipment is shown in FIGS. 4 and 5 that is known to work well with the preferred airline game. One or more cards 410 are typically printed and included with the game equipment, that show the chosen tables of values. In card 410, the term "class" is used in lieu of the term "category" for air routes. Individualized Player Note Cards 420 are preferably used to track each player's individual progress. The Player Note Card 420 features a space 430 for the player to keep track of their increasing salary. The Player Note Card 420 also features a space 440 for the player to calculate her Net Worth at the end of the game. The Player Note Card 420 additionally features a space 450 for the player to keep track of the number of reservations that she has made so far. The space features two columns 453 and 456. Column 453 contains ordinal numbers (e.g. "1st", "2nd", etc.) of possible reservations, while column 456 shows the (increasing) cost to make a subsequent reservation. Thus a Player Note Card is also used to control snowballing, as will be explained below.

A further type of markers for use with such games will now be described. The marker is called a Salary Token, and stands for the person's salary of one turn. While a salary can always be paid in money, a Salary Token may alternately be used instead of play money for payment of the salary, and will thus expedite the game. Additional recommended rules about use of Salary Tokens in a game are as follows: A player can accumulate Salary Tokens for as long as she does not need to spend the cash value they represent. Moreover, Salary Tokens can be used in lieu of money, during the player's occasional transactions with the Bank. Salary Tokens can be "cashed in" at any time for the total value of play money they represent, and they must be cashed in before the player's salary rate is about to be changed. Salary Tokens may not be traded among players for cash or under the terms of a negotiation.

Control of snowballing

A phenomenon in board games of the prior art is inflation of the money supply against fixed asset prices. The phenomenon is also known as "snowballing", and happens when the amount of money of (at least one of) the players becomes so large, that the price of assets available for purchase becomes insignificant.

Given that a salary is paid at every turn, and additionally its rate increases during the game, the evolution of a game according to the preferred rules is subject to the possibility of snowballing. This possibility is dealt with in a number of ways. First, amphidrome boards inherently present a menu of cheap and more expensive assets. These more expensive assets are the passage routes with the longer jumps, and their price will still challenge a more advanced player. Second, the salary increase on the passage routes of a longer jump can be less (as a percentage) than that for the passage routes of a shorter jump. Such is actually embodied in the values of card 410. This decrease is compensated by the fact that a longer jump already benefits the player in other ways, i.e. with enhanced mobility.

Furthermore, the airline game controls the effects of snowballing by individualizing to each player a component of the purchase price that the player must pay for controlling an asset. This is accomplished by each player having and using an individual Player Note Card during the game. Raising gradually the cost of a subsequent reservation raises gradually and indirectly the cost of purchasing an asset, with higher costs to more advanced players. (It is preferred that the cost escalation stops and levels off after a certain number of reservations has been made.) Thus a degree of challenge is maintained even to more advanced players.

Conclusion

In view of the present description, a person skilled in the art of designing board games will see that, once some of the above basic design choices are made regarding an amphidrome board and a set of rules, it will be relatively easy to come up with details to enhance the amphidrome board, valuation to arrive at numbers, details to complete the rules, context and other features to augment the design of the whole game, to produce a game belonging to the class of games of establishing and/or acquiring control of passage routes.

What is claimed is:

1. A method for playing a game of establishing and/or acquiring control of passage routes, the game to be played by a plurality of players using tokens, markers and an amphidrome board presenting at least one track subdivided in token spaces, some of the token spaces of the track being grouped in predetermined stations in such a way that there are at least two distinct stations in the track, the method comprising the steps of:

a first player making a token movement of a token on the amphidrome board, the token movement being one of predefined allowable combinations of track movements on the track according to predefined track movement rules of the game and passage route movements through passage routes according to predefined passage route movement rules of the game, the passage route movement rules being different from the track movement rules;

a second, and then all succeeding players in turn repeating the same steps as the first player, thus completing a round of play; and the players repeating and completing rounds of play, until a predefined ending condition is met during a final round, wherein at least once during the game one of the players additionally performs, according to establishment rules of the game, the step of using a marker on the amphidrome board to denote establishment of a passage route connecting a first station to a second station distinct from the first station.

2. The method of claim 1, wherein the predefined ending condition is that players have established all passage routes that the establishment rules of the game permit establishing.

3. The method of claim 1, wherein, if the final round of play is not completed, players further repeat the same steps as the first player to complete the final round of play.

4. The method of claim 3, wherein the predefined ending condition is that players have established all passage routes that the establishment rules of the game permit establishing.

5. A method for playing a game of establishing and/or acquiring control of passage routes, the game to be played by a plurality of players using tokens, markers and an amphidrome board presenting at least one track subdivided in token spaces, some of the token spaces of the track being grouped in predetermined stations in such a way that there are at least two distinct stations in the track, the amphidrome board further presenting at least one passage route connecting two distinct stations, the method comprising the steps of:

a first player making a token movement of a token on the amphidrome board, the token movement being one of predefined allowable combinations of track movements on the track according to predefined track movement rules of the game and passage route movements through passage routes according to predefined passage route movement rules of the game, the passage route movement rules being different from the track movement rules;

a second, and then all succeeding players in sequence repeating the same steps as the first player, thus completing a round of play; and the players repeating and completing rounds of play, until a predefined ending condition is met during a final round, wherein at least once during the game one of the players additionally performs, according to acquisition of control rules of the game, the step of using a marker on the amphidrome board to denote acquisition of control of a passage route connecting a first station to a second station distinct from the first station, wherein acquisition of control of a passage route by the player is to the exclusion of the other players.

6. The method of claim 5, wherein the amphidrome board further presents one passage route indicator space associated with each passage route, and wherein the differentiated markers are color differentiated stand alone pieces, and wherein the step of using a marker on the amphidrome board is by placing the marker on a passage route indicator space.

7. The method of claim 6, wherein the amphidrome board further presents one reservation area associated with each station, and wherein the method further comprises the step of the first player placing a marker on a reservation area of a station to secure a reservation at the station, if desired by the first player and permitted by the acquisition of control rules of the game, and wherein the using a marker to denote acquisition of control step further comprises the first player removing a marker from the reservation areas associated with each of the first station and the second station to surrender the two corresponding reservations.

8. The method of claim 5, wherein, if the final round of play is not completed, players further repeat the same steps as the first player to complete the final round of play.

9. The method of claim 8, wherein the amphidrome board presents one passage route indicator space associated with each passage route, and wherein the differentiated markers are color differentiated stand alone pieces, and wherein the step of using a marker on the amphidrome board is by placing the marker on a passage route indicator space.

10. The method of claim 9, wherein the amphidrome board further presents one reservation area associated with each station, and wherein the method further comprises the step of the first player placing a marker on a reservation area of a station to secure a reservation at the station, if desired by the first player and permitted by the acquisition of control rules of the game, and wherein the using a marker to denote acquisition of control step further comprises the first player removing a marker from the reservation areas associated with each of the first station and the second station to surrender the two corresponding reservations.

11. The method of claim 5, wherein the predefined ending condition is that players have acquired control of all passage routes that the acquisition of control rules of the game permit acquiring control of.

12. The method of claim 11, wherein the amphidrome board presents one passage route indicator space associated with each passage route, and wherein the differentiated markers are color differentiated stand alone pieces, and wherein the step of using a marker on the amphidrome board is by placing the marker on a passage route indicator space.

13. The method of claim 12, wherein the amphidrome board further presents one reservation area associated with each station, and wherein the method further comprises the step of the first player placing a marker on a reservation area of a station to secure a reservation at the station, if desired by the first player and permitted by the acquisition of control rules of the game, and wherein the using a marker to denote acquisition of control step further comprises the first player removing a marker from the reservation areas associated with each of the first station and the second station to surrender the two corresponding reservations.

14. The method of claim 11, wherein, if the final round of play is not completed, players further repeat the same steps as the first player to complete the final round of play.

15. The method of claim 14, wherein the amphidrome board presents one passage route indicator space associated with each passage route, and wherein the differentiated markers are color differentiated stand alone pieces, and wherein the step of using a marker on the amphidrome board is by placing the marker on a passage route indicator space.

16. The method of claim 15, wherein the amphidrome board further presents one reservation area associated with each station, and wherein the method further comprises the step of the first player placing a marker on a reservation area of a station to secure a reservation at the station, if desired by the first player and permitted by the acquisition of control rules of the game, and wherein the using a marker to denote acquisition of control step further comprises the first player removing a marker from the reservation areas associated with each of the first station and the second station to surrender the two corresponding reservations.

* * * * *